US011006794B2

(12) United States Patent
Cho et al.

(10) Patent No.: US 11,006,794 B2
(45) Date of Patent: May 18, 2021

(54) CLEANER

(71) Applicant: SAMSUNG ELECTRONICS CO., LTD., Suwon-si (KR)

(72) Inventors: Young Jun Cho, Suwon-si (KR); Won Kyu Lim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 265 days.

(21) Appl. No.: 16/074,929

(22) PCT Filed: Feb. 3, 2017

(86) PCT No.: PCT/KR2017/001195
§ 371 (c)(1),
(2) Date: Aug. 2, 2018

(87) PCT Pub. No.: WO2017/135735
PCT Pub. Date: Aug. 10, 2017

(65) Prior Publication Data

US 2019/0029481 A1 Jan. 31, 2019

(30) Foreign Application Priority Data

Feb. 5, 2016 (KR) ..... 10-2016-0014744

(51) Int. Cl.

| | |
|---|---|
| ***A47L 5/36*** | (2006.01) |
| ***A47L 9/00*** | (2006.01) |
| ***A47L 5/32*** | (2006.01) |
| ***A47L 9/10*** | (2006.01) |
| ***A47L 5/24*** | (2006.01) |

(52) U.S. Cl.
CPC ..... *A47L 5/362* (2013.01); *A47L 5/24* (2013.01); *A47L 5/32* (2013.01); *A47L 5/36* (2013.01); *A47L 9/00* (2013.01); *A47L 9/009* (2013.01); *A47L 9/10* (2013.01); *A47L 9/102* (2013.01)

(58) Field of Classification Search
CPC ... A47L 5/362; A47L 9/10; A47L 5/36; A47L 9/00; A47L 5/24; A47L 5/32; A47L 9/009; A47L 9/102
See application file for complete search history.

(56) References Cited

U.S. PATENT DOCUMENTS

| | | | |
|---|---|---|---|
| 5,640,740 | A | 6/1997 | Martin et al. |
| 2011/0088198 | A1 | 4/2011 | Wills et al. |

(Continued)

FOREIGN PATENT DOCUMENTS

| | | |
|---|---|---|
| EP | 1 129 657 A1 | 9/2001 |
| JP | 2005-160814 | 6/2005 |

(Continued)

OTHER PUBLICATIONS

European Office Action dated Dec. 17, 2018 from European Patent Application No. 17747780.9, 6 pages.

(Continued)

*Primary Examiner* — David Redding
(74) *Attorney, Agent, or Firm* — Staas & Halsey LLP

(57) ABSTRACT

A cleaner comprises a cleaner main body, a first main body formed in a spherical shape and a second main body protruding from the front of the first main body such that the width at a second point located forward of a first point is smaller than the width at the first point.

15 Claims, 17 Drawing Sheets

(56) References Cited

U.S. PATENT DOCUMENTS

| | | | | |
|---|---|---|---|---|
| 2012/0079674 | A1 | 4/2012 | Dyson et al. | |
| 2013/0305485 | A1* | 11/2013 | Moloney | A47L 5/362 15/353 |
| 2017/0332854 | A1* | 11/2017 | Kim | A47L 9/244 |

FOREIGN PATENT DOCUMENTS

| | | |
|---|---|---|
| KR | 2001-0087225 | 9/2001 |
| KR | 20-0344840 | 3/2004 |

OTHER PUBLICATIONS

Israel Office Action dated Oct. 23, 2019 in corresponding Israel Patent Application No. 260710.
International Search Report dated May 12, 2017 in corresponding International Patent Application No. PCT/KR2017/001195.
Written Opinion of the International Searching Authority dated May 12, 2017 in corresponding International Patent Application No. PCT/KR2017/001195.

* cited by examiner

[Fig. 1]
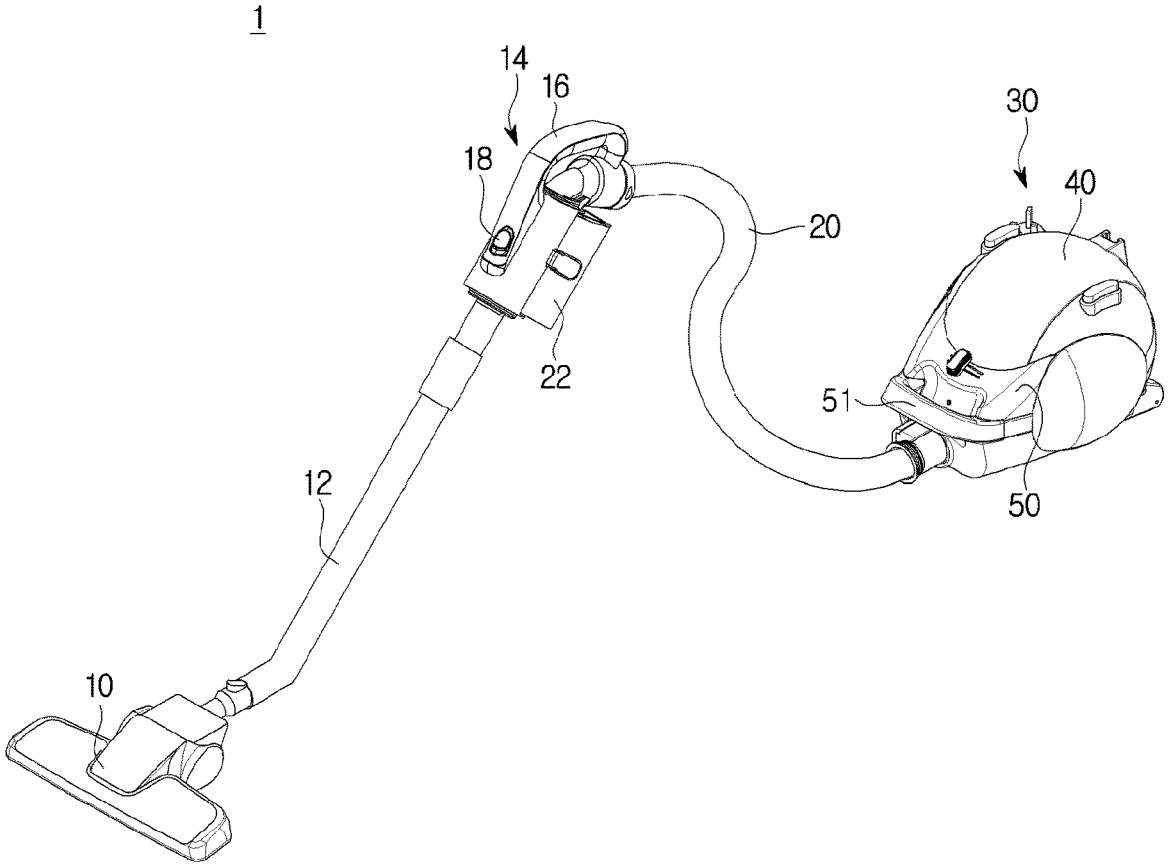

[Fig. 2]
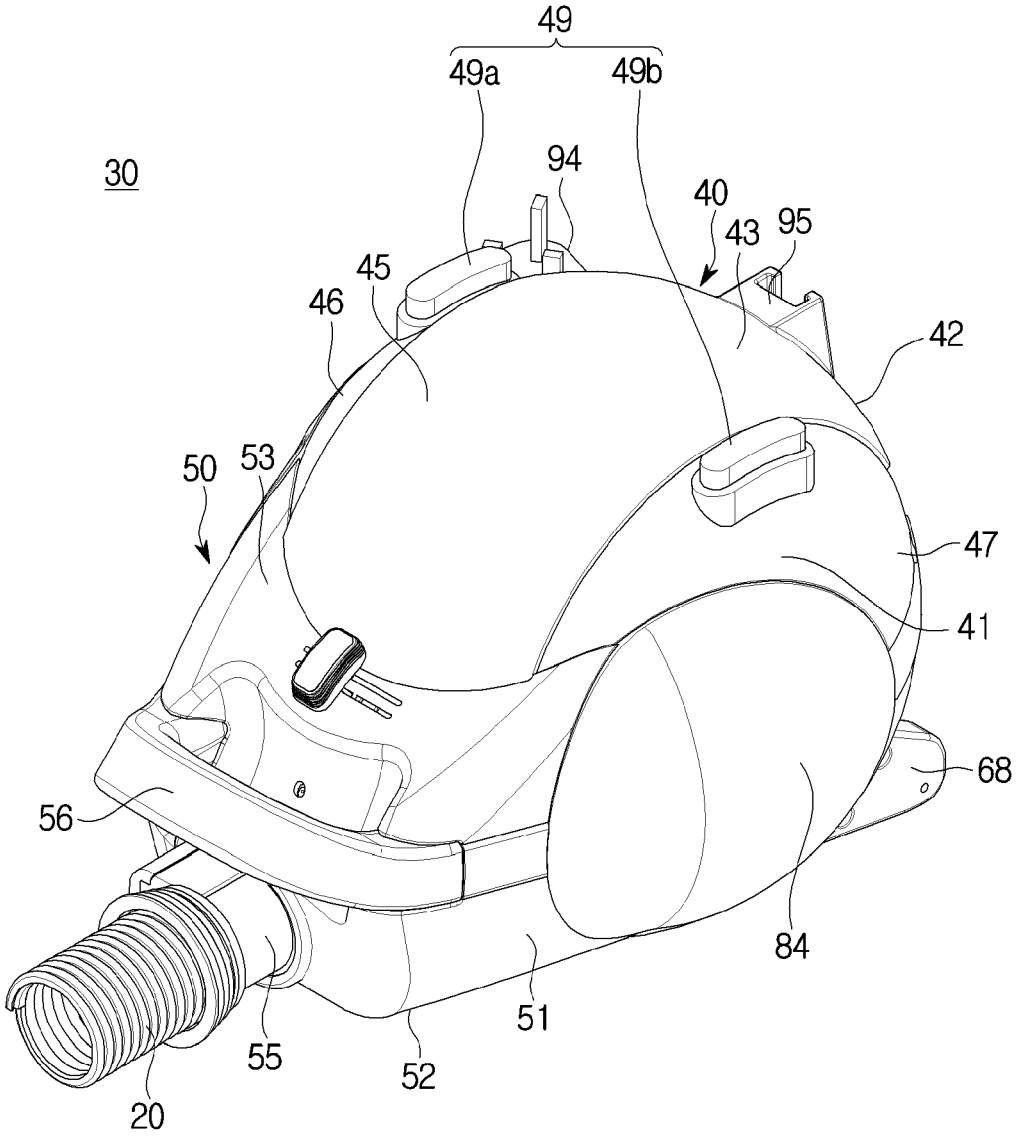

[Fig. 3]
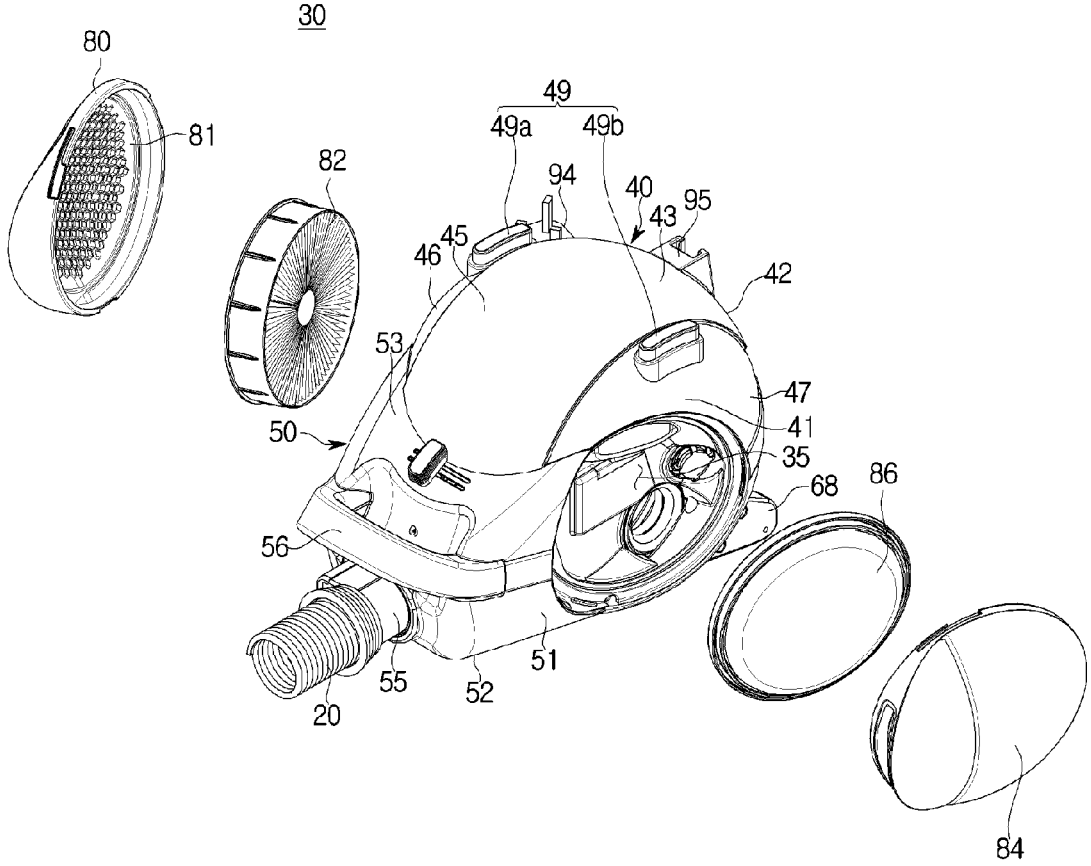

[Fig. 4]
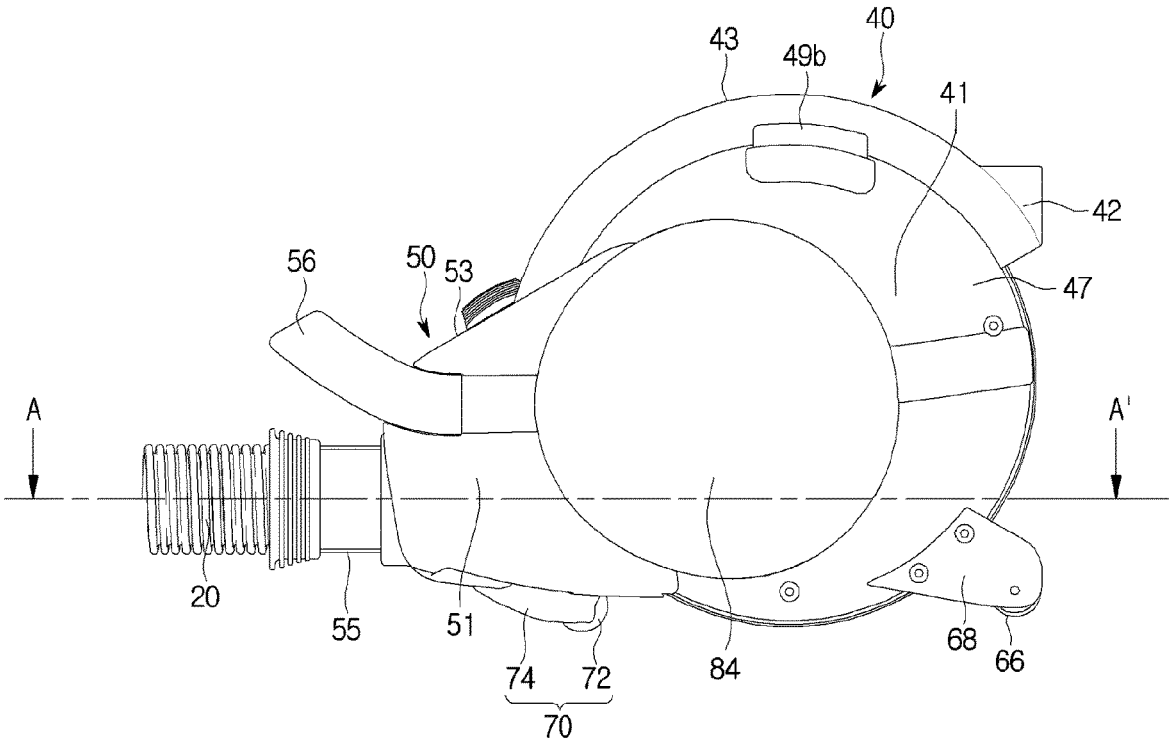

[Fig. 5]
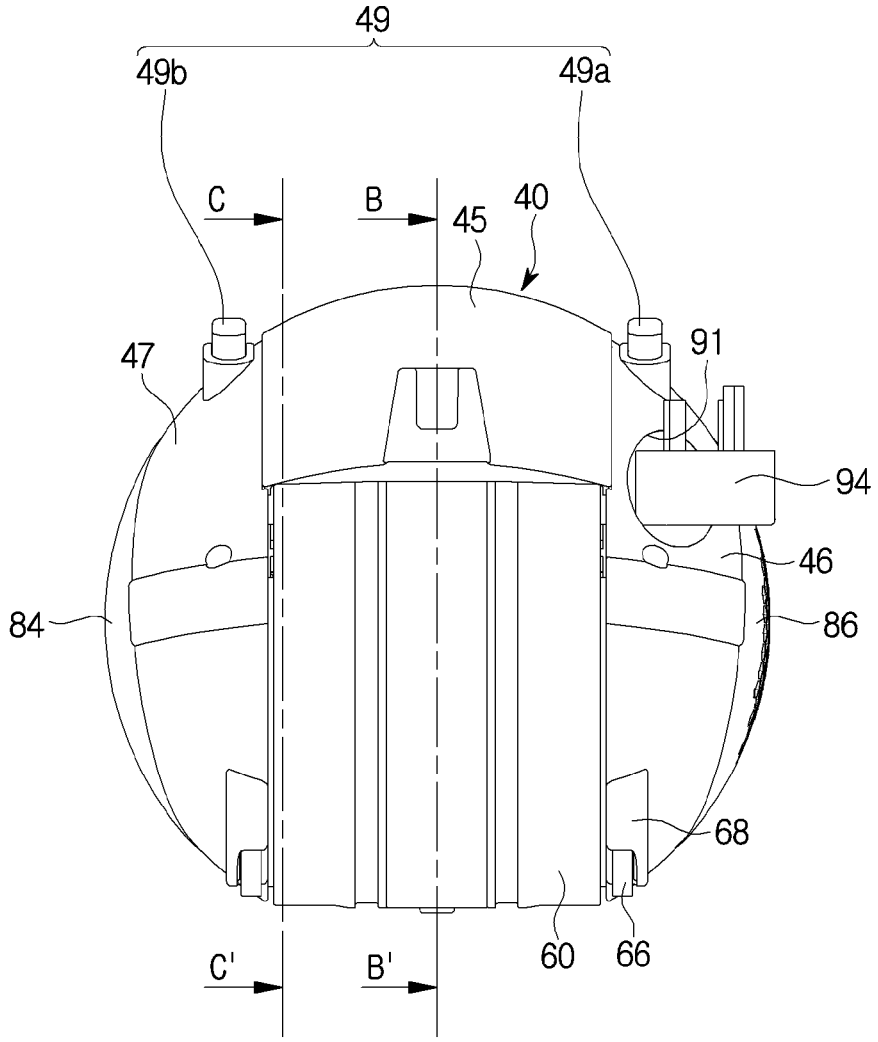

[Fig. 6]
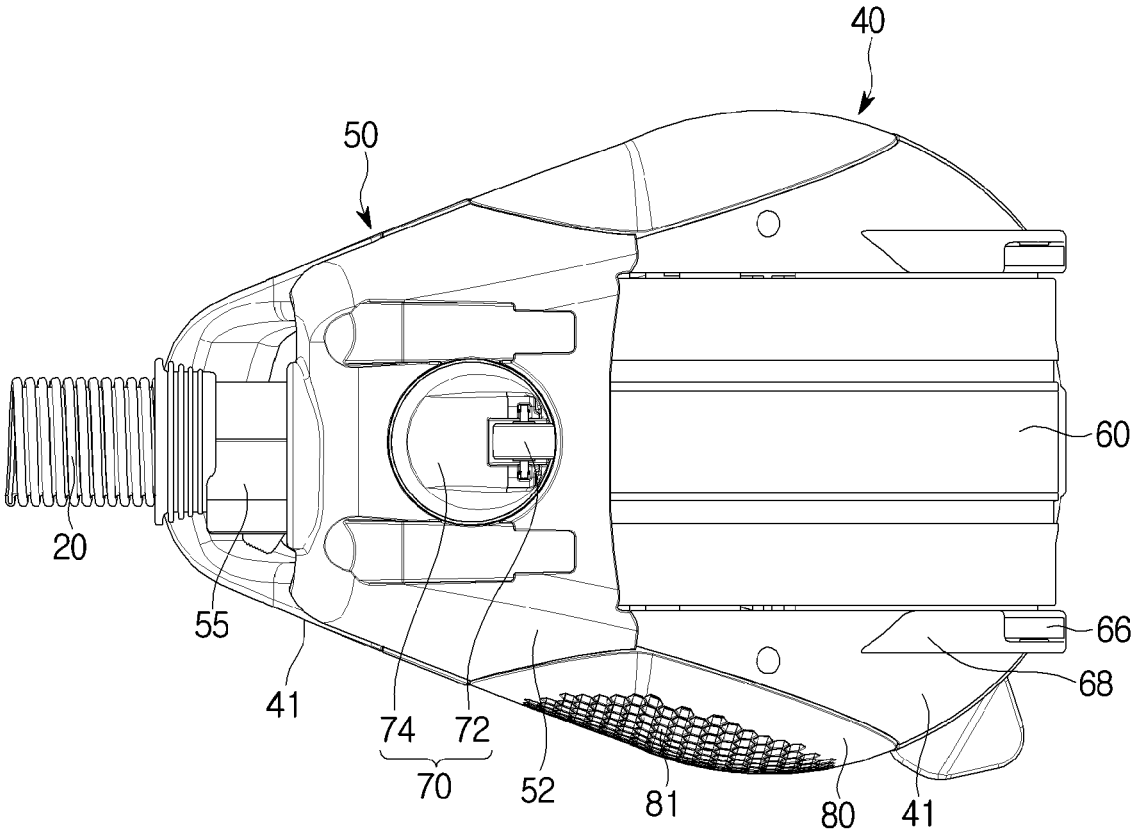

[Fig. 7]
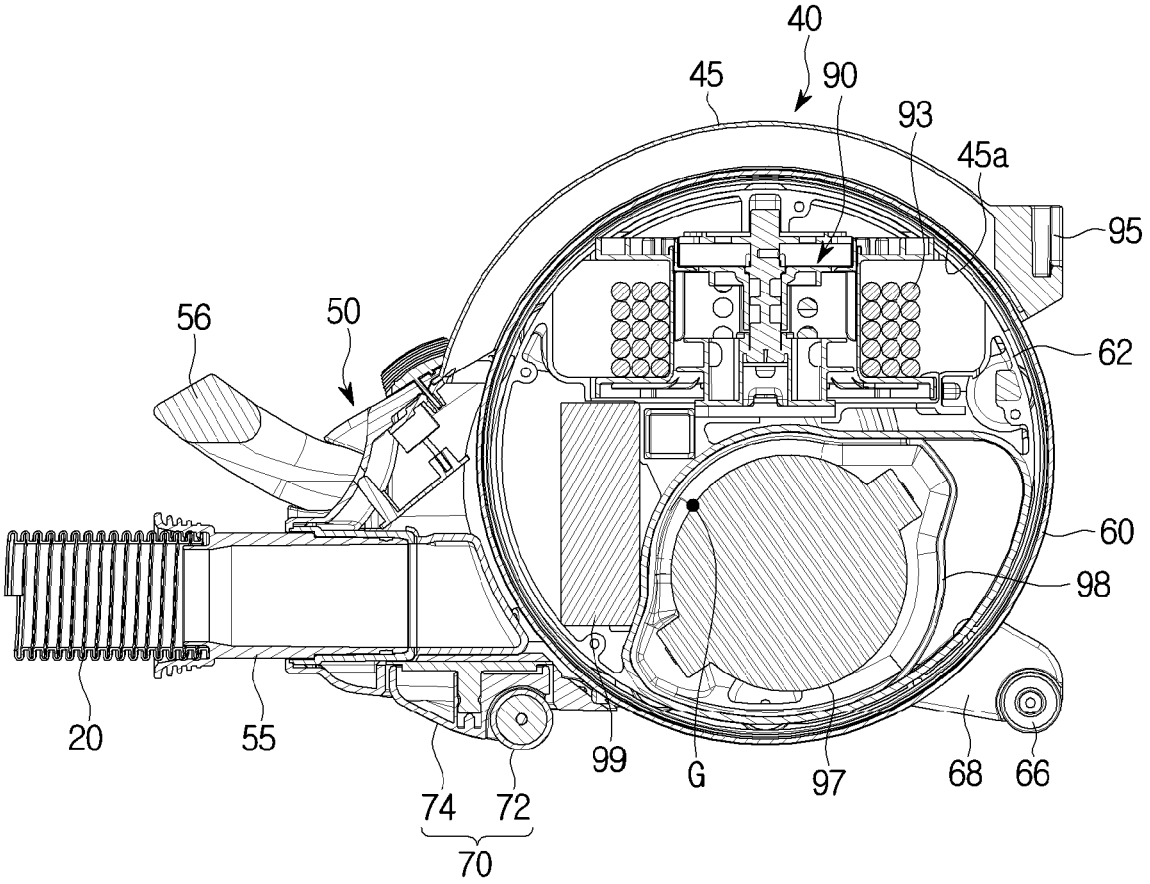

[Fig. 8]
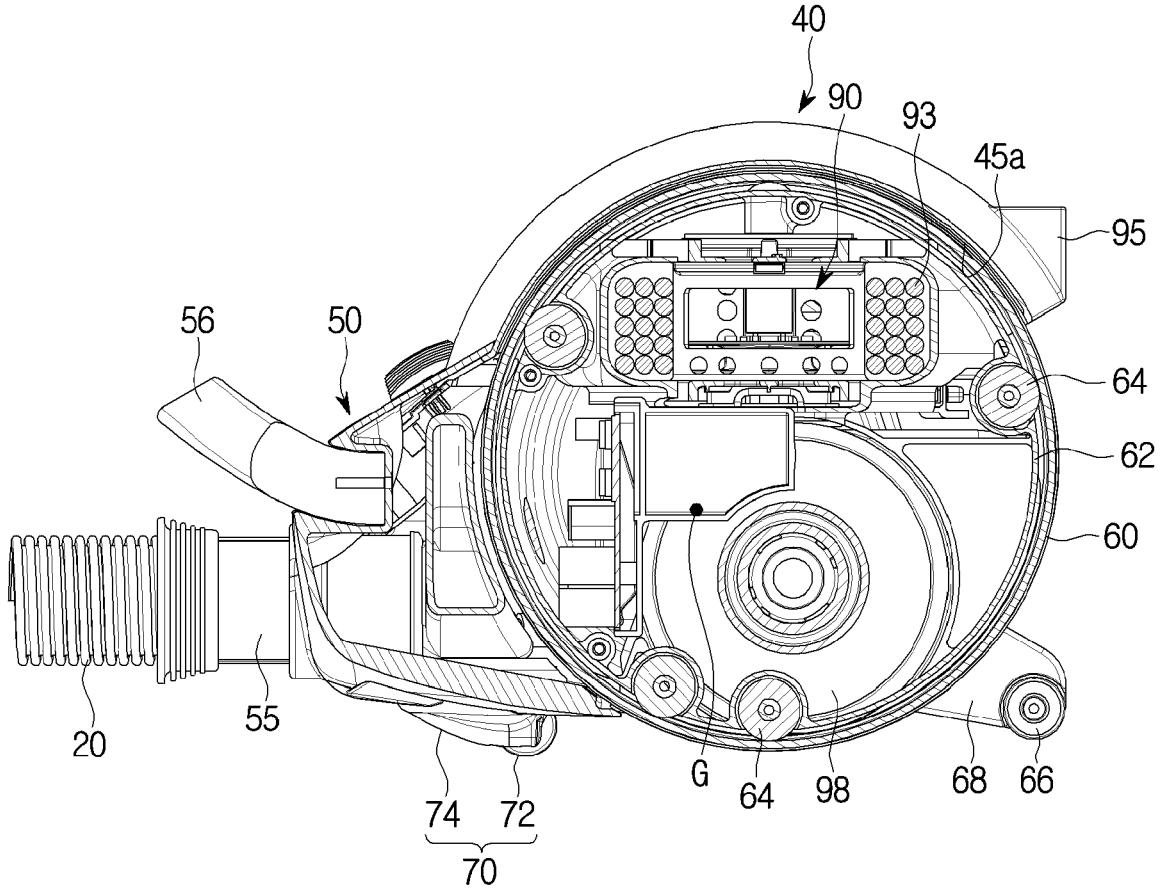

[Fig. 9]
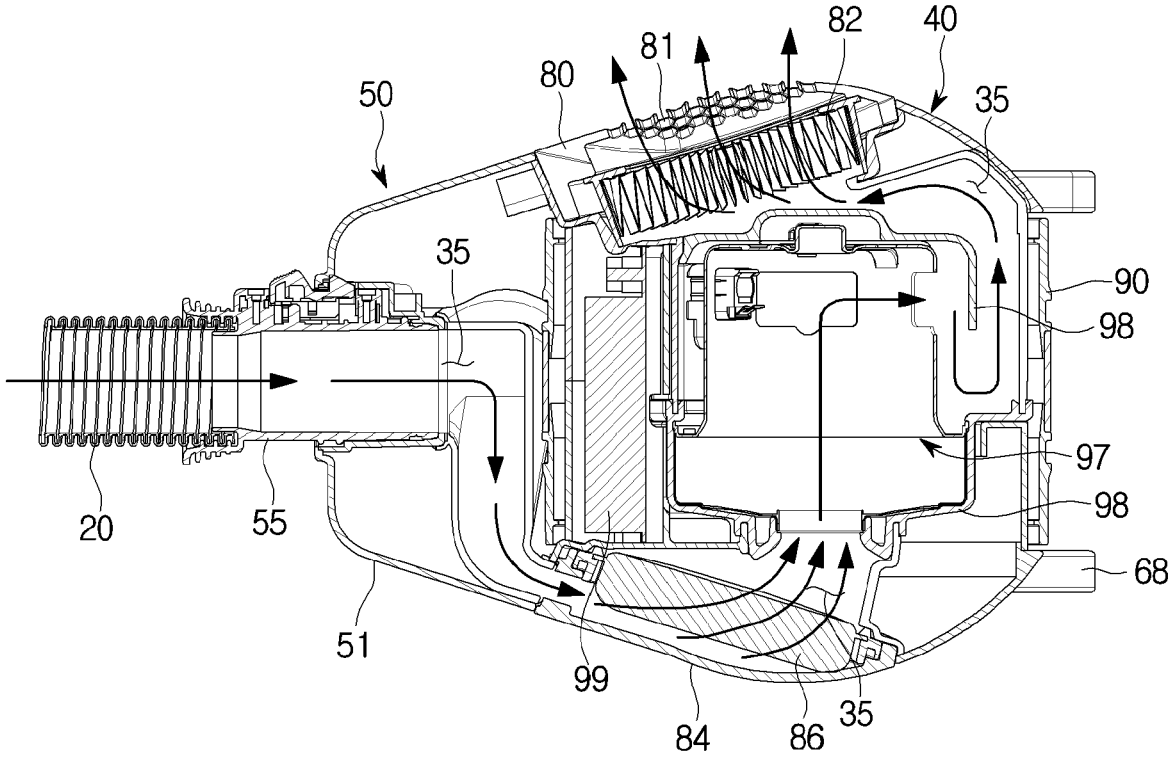

[Fig. 10]
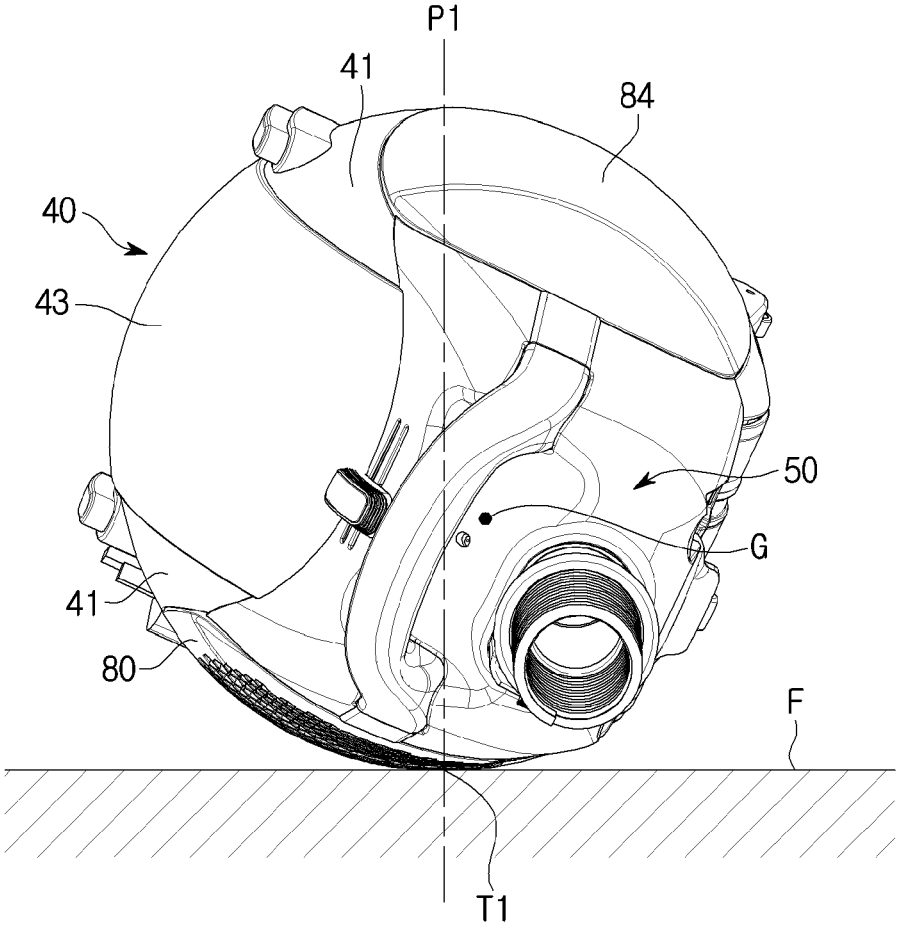

[Fig. 11]
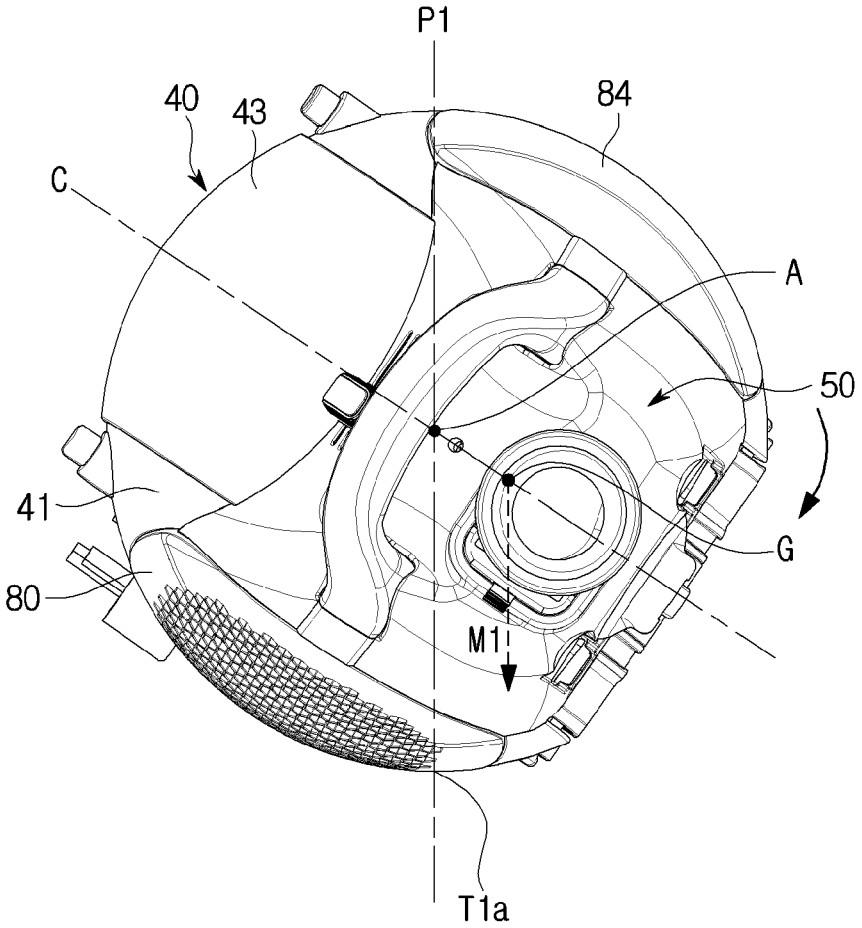

[Fig. 12]
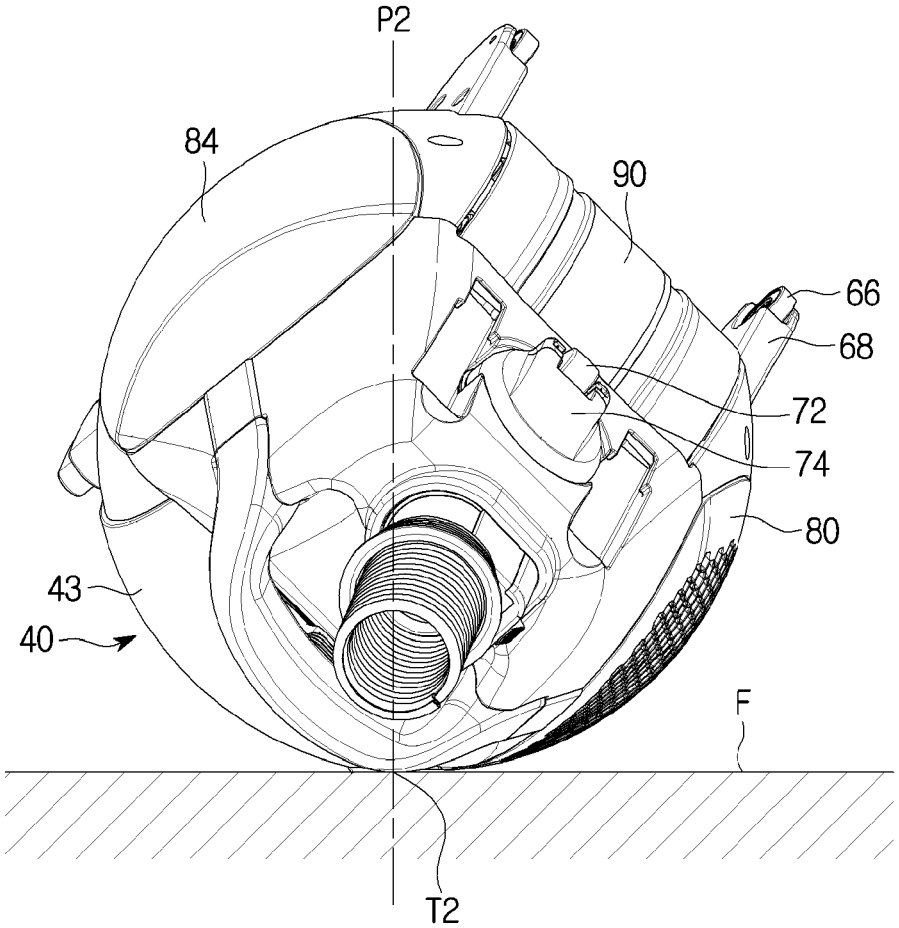

[Fig. 13]
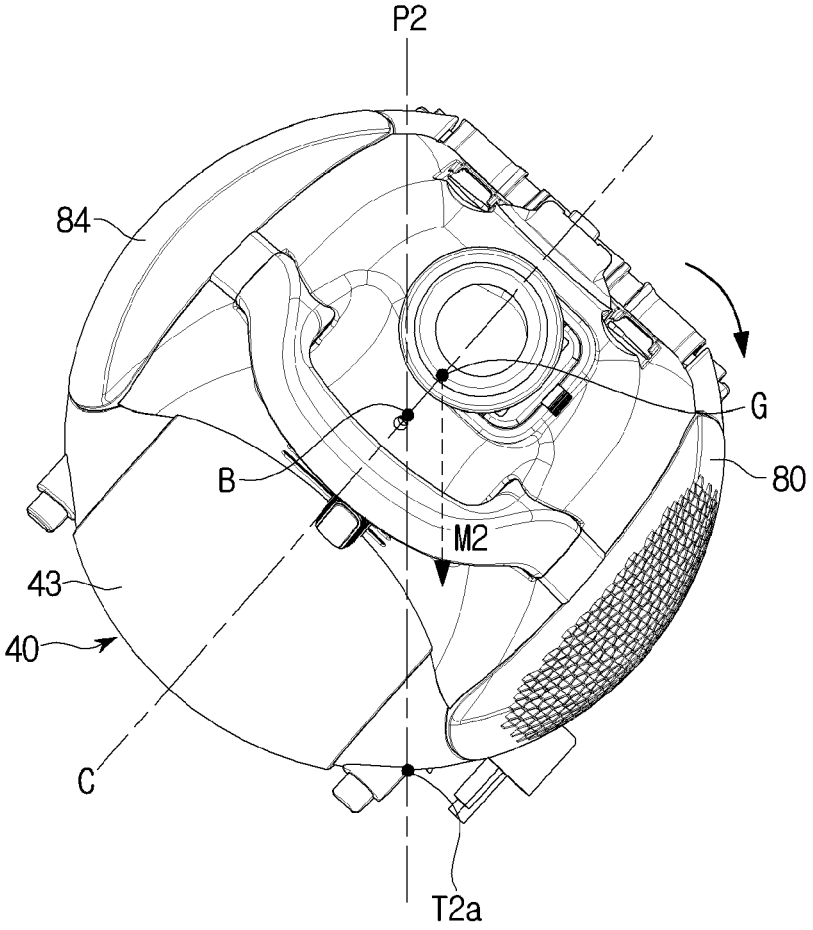

[Fig. 14]
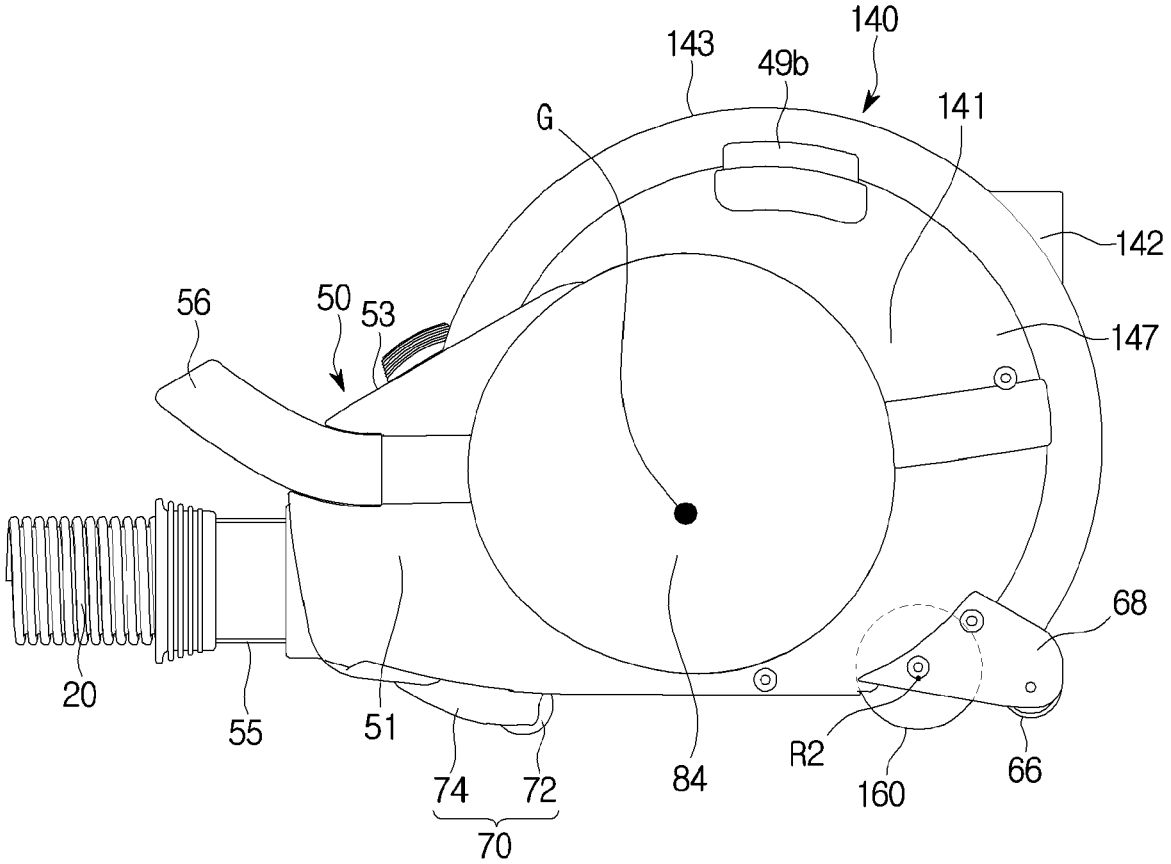

[Fig. 15]
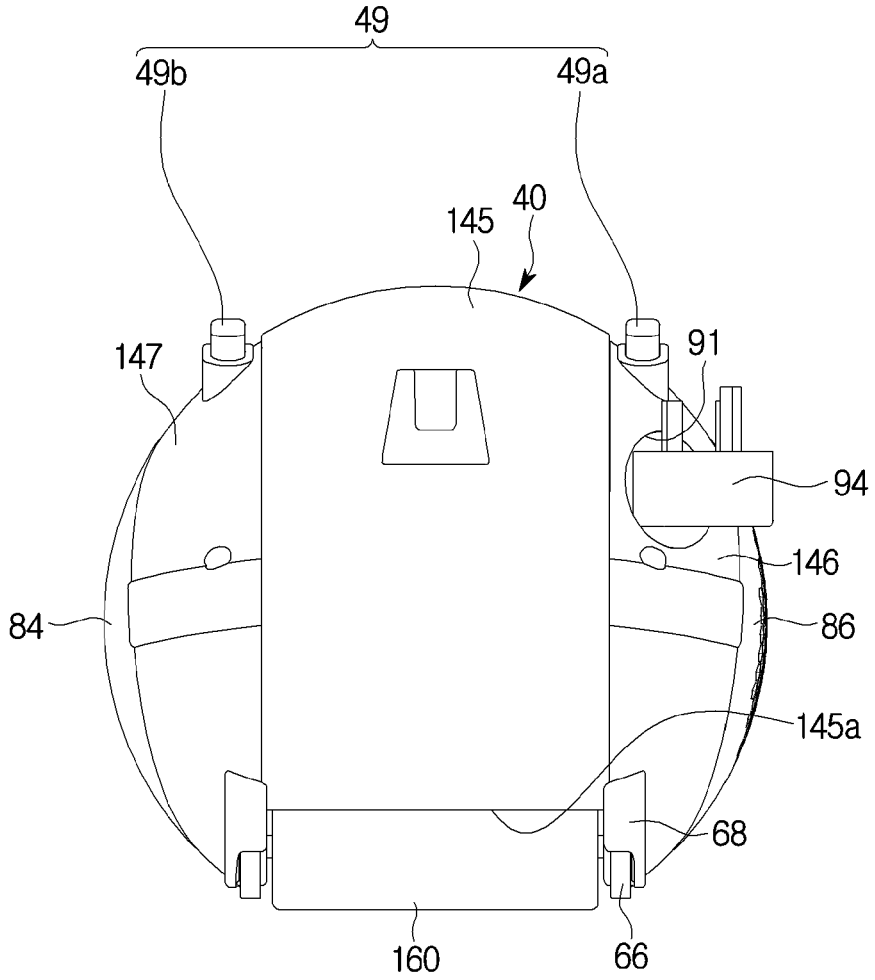

[Fig. 16]
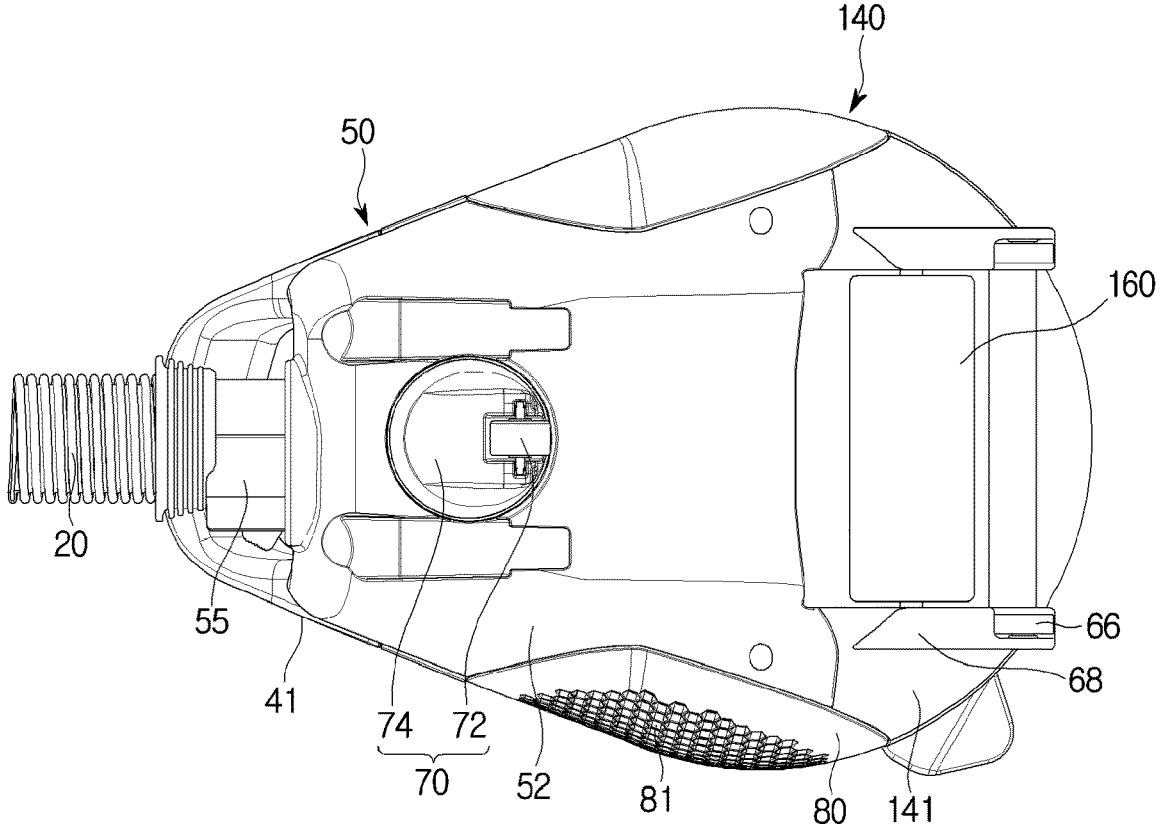

[Fig. 17]
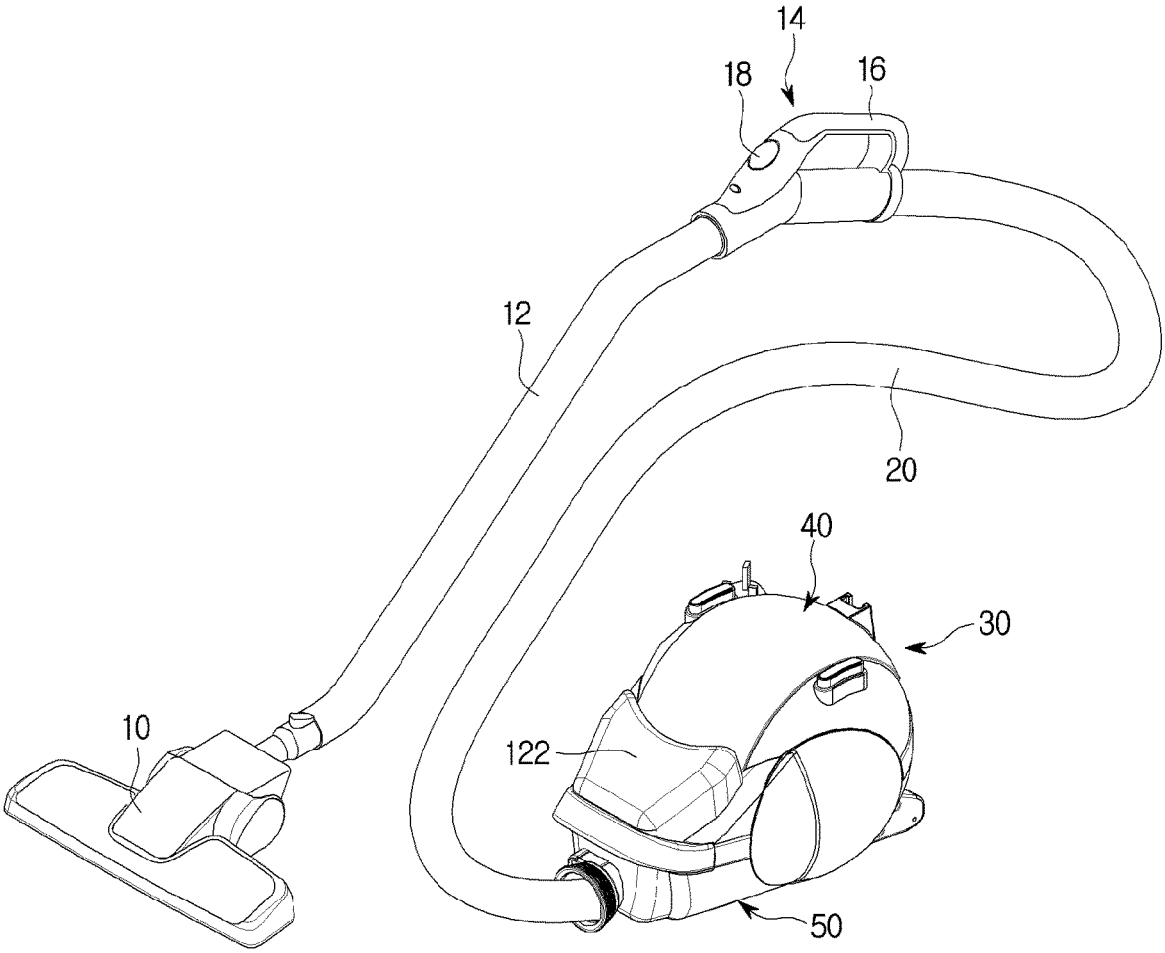

CLEANER

CROSS-REFERENCE TO RELATED APPLICATIONS

This application is a U.S. National Stage Application, which claims the benefit under 35 U.S.C. § 371 of International Patent Application No. PCT/KR2017/001195 filed on Feb. 3, 2017, which claims the foreign priority benefit under 35 U.S.C. § 119 of Korean Patent Application No. 10-2016-0014744, filed Feb. 5, 2016, the contents of which are incorporated herein by reference.

TECHNICAL FIELD

The present disclosure relates to a cleaner, and more particularly, to a cleaner having improved driving efficiency.

BACKGROUND ART

A cleaner is a device that removes foreign substances in a room. Generally, vacuum cleaners are widely used in homes. The vacuum cleaner sucks in air using the suction force of a blower and separates the foreign substances in the inhaled air by a device such as a filter to clean the room. These vacuum cleaners are classified into a canister type and an upright type.

The upright type cleaner has an upright main body, a suction body integrally coupled to the lower part of the main body, a wheel that allows the main body to move along a floor surface, and a handle that a user grips.

On the other hand, the canister type cleaner includes a main body in which a blowing device and a dust collecting device are built, a suction body installed separately from the main body for sucking dust on a floor, and a connection pipe connecting the suction body and a handle. Therefore, a user grasps the handle of the canister type cleaner and performs cleaning while moving the suction body in a direction to clean.

When using the canister type cleaner, the user moves the cleaner by manipulating the handle to clean. However, the main body connected to the handle may have difficulty in moving the cleaner as it loses track direction or overturns due to collision with an obstacle following a movement path.

DISCLOSURE

Technical Problem

One aspect of the present disclosure provides a cleaner in which a cleaner main body may balance itself.

One aspect of the present disclosure provides a cleaner that improves the moving performance of a cleaner main body.

One aspect of the present disclosure provides a cleaner that improves the utilization of the internal space of a cleaner main body.

Technical Solution

In accordance with one aspect of the disclosure, a cleaner includes a cleaner main body, a first main body formed in a spherical shape and a second main body protruding from the front of the first main body such that the width at a second point located forward of a first point is smaller than the width at the first point.

Both side surfaces of the second main body extend from both side surfaces of the first main body.

Both side surfaces of the second main body are formed in a plane having a curvature at least partially in a vertical direction.

The second main body protrudes forward and downward from the first main body.

The second main body is protruded such that the height at the second point is smaller than the height at the first point.

The second main body is formed with curved surfaces at both lower sides thereof.

The second main body is arranged that a curvature at a lower portion of both side surfaces of the second main body at the second point, which is provided in front of the first point, is larger than a curvature at both sides of the second main body at the first point.

The cleaner further includes a moving wheel that rotates along an inner circumferential surface of the first main body and is rotatably provided for movement of the cleaner main body.

The moving wheel is arranged at the center of the cleaner main body.

The first main body includes a central main body in which the moving wheel is disposed and a left and right main body provided on left and right sides of the central main body.

The central main body is opened such that at least a part of the moving wheel is exposed on a floor surface.

The cleaner further includes a pair of auxiliary wheels disposed on both sides of the moving wheel and protruding rearward from the cleaner main body.

The cleaner further includes a direction switching unit provided below the second main body and rotatable in the left and right direction for changing the direction of the cleaner main body.

The cleaner main body further includes a discharge plate having at least one of both sides of the first main body provided with a discharge port through which air sucked into the cleaner main body is discharged, and the cleaner further includes an exhaust filter provided inside a suction port to filter the air flowing through the cleaner.

The discharge plate is detachably provided from the cleaner main body, and the exhaust filter is detachably provided through a space in which the discharge plate is separated.

In accordance with one aspect of the disclosure, a cleaner includes a cleaner main body and at least one moving wheel rotatable for movement of the cleaner main body at a center of the cleaner main body, the at least one moving wheel being configured to rotate along an inner circumferential surface of the cleaner main body.

The cleaner main body includes a first main body formed in a spherical shape, and the at least one moving wheel is disposed along an inner circumferential surface of the first main body.

The first main body includes a central main body in which the moving wheel is disposed and a left and right main body provided on left and right sides of the central main body.

The central main body is opened such that at least a part of the moving wheel is exposed on a floor surface.

*The cleaner main body further includes a second main body protruding from the front of the first main body such that the width at a second point located forward of the first point is smaller than the width at the first point.

The at least one moving wheel includes a plurality of the moving wheels that are segmented in a rotational direction and rotate in parallel.

Advantageous Effects

This cleaner improves the structure of the cleaner main body so that the cleaner main body may balance itself.

In addition, by improving the wheel structure in the cleaner main body, the movement performance of the cleaner main body may be improved, and the cleaner main body may be miniaturized.

Also, the cleaner may stabilize the center of gravity of the cleaner main body, improve the cleaner's resilience, and improve the usability of the cleaner main body interior space.

DESCRIPTION OF DRAWINGS

FIG. 1 is a perspective view of a cleaner according to an embodiment of the present disclosure.

FIG. 2 is a perspective view of a cleaner main body according to an embodiment of the present disclosure.

FIG. 3 is a partially exploded perspective view of a cleaner main body according to an embodiment of the present disclosure.

FIG. 4 is a side view of a cleaner main body according to an embodiment of the present disclosure.

FIG. 5 is a rear view of a cleaner main body according to an embodiment of the present disclosure.

FIG. 6 is a bottom view of a cleaner main body according to an embodiment of the present disclosure.

FIG. 7 is a sectional view taken along line B-B' in FIG. 5.

FIG. 8 is a cross-sectional view taken along line C-C' in FIG. 5.

FIG. 9 is a sectional view taken along line A-A' in FIG. 4.

FIGS. 10 to 13 are views illustrating rolling operations of a cleaner main body according to an embodiment of the present disclosure.

FIG. 14 is a side view of a cleaner main body according to another embodiment of the present disclosure.

FIG. 15 is a rear view of a cleaner main body according to another embodiment of the present disclosure.

FIG. 16 is a bottom view of a cleaner main body according to another embodiment of the present disclosure.

FIG. 17 is a perspective view of a cleaner according to another embodiment of the present disclosure.

BEST MODE

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform substantially the same functions.

The terms used in the present specification are used to describe the embodiments of the present disclosure. Accordingly, it should be apparent to those skilled in the art that the following description of exemplary embodiments of the present disclosure is provided for illustration purposes only and not for the purpose of limiting the disclosure as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more associated listed items.

Hereinafter, the embodiments of the present disclosure will be described in detail with reference to the accompanying drawings.

FIG. 1 is a perspective view of a cleaner according to an embodiment of the present disclosure.

A cleaner 1 according to the embodiment of the present disclosure may include a cleaner main body 30, a head unit 10, an extension pipe 12, a handle assembly 14, and a hose 20.

A suction unit provided in the head unit 10 may contact the surface to be cleaned and suck foreign matter on the surface to be cleaned. The cleaner according to an embodiment of the present disclosure may be a canister type vacuum cleaner.

The extension pipe 12 in a stick shape is connected to the head unit 10. The extension pipe 12 is made of resin or metal and may connect the head unit 10 and the handle assembly 14. The extension pipe 12 may be pivotally connected to the head unit 10 and may be provided for joint movement.

The handle assembly 14 is provided to connect the extension pipe 12 and the hose 20. The handle assembly 14 may be provided with a handle 16 and a controller 18. A user may grip and clean the handle 16 and manipulate the functions of the cleaner such as turning on/off the cleaner or adjusting the suction intensity by operating a button or the like provided on the controller 18.

The hose 20 connects the handle assembly 14 and the cleaner main body 30. The hose 20 may be provided with a flexible material for free movement of the handle assembly 14. The hose 20 may be connected to a suction pipe 55 of the cleaner main body 30.

A dust separator 22 may be removably provided on the handle assembly 14. The dust separator 22 is provided to filter foreign matter in the air flowing from the head unit 10. In the present embodiment, the dust separator 22 is provided in the handle assembly 14 to filter foreign substances in the air in advance of the cleaner main body 30. To this end, the air passing through the head unit 10 and the extension pipe 12 is provided to flow to the hose 20 through the dust separator 22. However, the arrangement of the dust separator 22 is not limited to this, and the dust separator 22 may be provided in the main body 30 so as to be filtered by the main body 30.

The head unit 10, the extension pipe 12, the handle assembly 14, the dust separator 22, the hose 20, and the cleaner main body 30 may all be communicated with each other. That is, the air sucked from the head unit 10 may be discharged to the outside through the extension pipe 12, the handle assembly 14, the dust separator 22, the hose 20, and the cleaner main body 30.

FIG. 2 is a perspective view of a cleaner main body according to an embodiment of the present disclosure. FIG. 3 is a partially exploded perspective view of a cleaner main body according to an embodiment of the present disclosure. FIG. 4 is a side view of a cleaner main body according to an embodiment of the present disclosure. FIG. 5 is a rear view of a cleaner main body according to an embodiment of the present disclosure. FIG. 6 is a bottom view of a cleaner main body according to an embodiment of the present disclosure.

The cleaner main body 30 is configured to be connected to the hose 20 and move following it when the user moves the handle assembly 14. Inside the cleaner main body 30, a suction motor 97 is provided to allow the air to flow by the suction force generated by the suction motor 97.

The cleaner main body 30 is dragged by the hose 20 during the cleaning operation, and may turned over against an obstacle or a sudden corner section. The cleaner main body 30 of the present disclosure is provided so as to be able to return to its original state again even if it loses balance during the movement and turns over.

The cleaner main body 30 may include the suction motor 97 for generating a suction force therein and an inner air flow path 35 through which air flows.

The cleaner main body 30 includes a first main body 40 and a second main body 50.

The first main body 40 may have a spherical shape. However, the present disclosure is not limited to this, and the first main body 40 may have a spherical shape or an elliptical shape. In detail, the first main body 40 may have a curved upper surface 43 and both side surfaces 41. A rear surface 42 of the first main body 40 may also be formed as a curved surface. With this configuration, the first main body 40 may have a spherical shape as a whole.

Since the outer surface of the first main body 40 is curved, the first main body 40 may be rolled back to its original position even when the first main body 40 is tilted toward the left or right or turned over so that the upper surface 43 or the rear surface 42 contacts a bottom surface F.

The second main body 50 protrudes from the front of the first main body 40. The second main body 50 may protrude downward from the first main body 40 in a forward direction.

The second main body 50 is provided in front of the first main body 40 to prevent the first main body 40 from rotating forward. Also, the second main body 50 is provided so that the spherical first main body 40 may be stably moved along a movement path.

The second main body 50 may be formed to have a smaller width toward the front. That is, the second main body 50 may be provided such that the width of the second main body 50 at the second point located forward of the first point is smaller than the width of the second main point 50 at any first point. Both side surfaces 51 of the second main body 50 are provided to extend from the both side surfaces 41 of the first main body 40 so that they may have a substantially triangular shape when viewed from above. With this configuration, even if the main body 30 moves along the movement path and hits an obstacle, the impact may be minimized. Although not shown, a shock absorbing member may be provided on the both side surfaces 51 of the second main body 50. That is, the shock absorbing member covers both sides of the second main body 50, so that it is possible to absorb an impact on the obstacle.

The angle formed by the both side surfaces 51 of the second main body 50 is not limited, but may be formed by only 0 degrees or more and 90 degrees or less. Preferably, the angle may be 45 degrees.

The second main body 50 may be provided so that the height thereof decreases toward the front. That is, the second main body 50 may be provided such that the vertical height at the second point located forward of the first point is smaller than the vertical height at the first point. The second main body 50 is provided to extend from the upper and lower portions of the first main body 40, and thus may have a substantially triangular shape when viewed from the side. The angle formed by an upper surface 53 and a lower surface 52 of the second main body 50 is not limited, but may be formed to be greater than 0 degrees and less than 90 degrees. Preferably, the angle may be 60 degrees.

The both side surfaces 51 of the second main body 50 may extend from the both side surfaces 41 of the first main body 40. The both side surfaces 51 of the second main body 50 may be formed as a plane having a curvature in at least a part in a vertical direction. With such a configuration, when the cleaner main body 30 rotates transversely, it may smoothly return to its original position. In addition, when the main body 30 rolls, it is possible to form at least two points of contact with the bottom surface F or a tangent line T (see FIGS. 10 to 13).

In the second main body 50, lower portions of the both side surfaces 51 may be curved. This may correspond to a case where the first main body 40 is formed in a curved or spherical shape. The curvatures at the lower portions of the both side surfaces 51 at the second point located forward of the first point may be larger than the curvatures at the lower portions of the both side surfaces 51 at the first point of the second main body 50. With this configuration, the main body 30 may be returned to the original position stably while being rolled.

In the case where the main body 30 has only a spherical shape like the first main body 40, when the main body 30 rolls and the side surface of the main body 30 touches the bottom surface F, the main body 30 forms contact with the bottom surface F. In this case, as the position of the contact is continuously changed by the movement of the cleaner main body 30, the direction of the moment formed by the center of gravity (G) and the contact is changed. Therefore, even if the center of gravity (G) is located below the center of the main body 30, the balance is lost and returned unstably to the original position.

In the present embodiment, the main body 30 includes the first and second main bodies 40 and 50. When the main body 30 rolls and the side surface of the main body 30 touches the bottom surface F, the main body 30 forms tangents to the bottom surface F or at least two contact points. In this case, even if the cleaner main body 30 moves, the direction of the moment formed by the tangent line or at least two contact points with the center of gravity G becomes constant, and the main body 30 returns to the original position stably.

The center of gravity G of the cleaner main body 30 is located at the lower front than at the center of the main body 30. The operation or principle of returning when the cleaner main body 30 is inverted will be described in detail later.

The cleaner 1 may include a handle 56 for moving the cleaner main body 30 from one side of the cleaner main body 30. The handle 56 may be provided in front of the cleaner main body 30 and may extend from the cleaner main body 30. In this embodiment, the handle 56 is provided in front of the cleaner main body 30, but the position of the handle 56 is not limited.

As shown in FIG. 5, the cleaner 1 may include at least one moving wheel 60, which is rotatably provided for movement of the main body 30. The at least one moving wheel 60 may be provided, or a plurality of the moving wheels 60 may be provided in parallel.

The moving wheel 60 may be disposed along the center of the main body 30. In detail, the moving wheel 60 may be disposed along the center of the first main body 40. The moving wheel 60 is disposed along the center of the main body 30 so that both sides of the main body 30 may be arranged on both sides of the moving wheel 60. The first main body 40 includes a central main body 45 having an opening 45*a* at least partially opened so that the moving wheel 60 may penetrate and come into contact with the floor surface F, a left main body 46 disposed on the left side of the moving wheel 60 when viewed from the front of the main body 30 with respect to a forward direction of the main body 30, and a right main body 47 disposed on the right side of the moving wheel 60. The moving wheel 60 is disposed in the central main body 45 and the left and right main bodies 46 and 47 are disposed on each of the left and right sides of the moving wheel 60 to cover the left and right sides of the moving wheel 60, and it is possible to cover the left and right sides of the moving wheel 60 to minimize wear and damage due to external influences.

The moving wheel 60 may be eccentrically rotated on the rear side of the main body 30. The moving wheel 60 may be disposed along the inner surface of the first main body 40 and a center of rotation R1 may be provided to pass through a center C1 of the first main body 40. The main body 30 is provided to include the first main body 40 and the second main body 50 protruding forward of the first main body 40 so that the center of rotation of the moving wheel 60 may be biased eccentrically to the rear of the main body 30.

The width of the moving wheel 60 may be greater than the width of the left main body 46 or the right main body 47. With this configuration, the main body 30 may be stably supported on the floor surface F.

The moving wheel 60 is configured to be spaced apart from the inner surface of the central main body 45 in the central main body 45 and may rotate along the inner surface of the central main body 45. The rotation of the moving wheel 60 will be described in detail later.

The cleaner 1 may include a pair of auxiliary wheels 66 disposed adjacent to the moving wheel 60 to balance the cleaner.

The pair of auxiliary wheels 66 may be provided and may be disposed on the left and right sides of the moving wheel 60, respectively. The pair of auxiliary wheels 66 may be provided to the left main body 46 and the right main body 47, respectively. A pair of auxiliary wheel supports 68 protruding rearward from left and right main bodies 47 and the pair of auxiliary wheels 66 are configured to be rotatable on the pair of auxiliary wheel supports 68, respectively. The pair of auxiliary wheel supports 68 are protruded rearward from the main body 30 so that the main body 30 may be prevented from rotating backward. The pair of auxiliary wheels 66 may also be provided to balance the cleaner main body 30 on the right and left sides of the moving wheel 60.

The cleaner 1 may include a direction switching unit 70 for redirecting the cleaner main body 30. The direction switching unit 70 is positioned in front of the moving wheel 60 and is provided to be able to rotate when the direction of the cleaner main body 30 is changed. In detail, the direction switching unit 70 may be provided at a lower portion of the second main body 50.

The direction switching unit 70 may include a direction switching plate 74 and a direction switching wheel 72. The direction switching plate 74 is rotatably provided with respect to the main body 30 and a rotation axis is formed in the vertical direction of the cleaner main body 30. That is, the direction switching plate 74 is formed to be rotatable in the left-right direction. The direction switching wheel 72 is provided to rotate independently of the direction switching plate 74 and is provided under the direction switching plate 74 so as to be supported on the bottom surface F.

When the direction of movement of the main body 30 is changed, the direction switching wheel 72 is rotated in the left-right direction together with the direction switching plate 74 and supports the second main body 50 from the bottom surface F.

The cleaner 1 may include an discharge port 81 through which the air passing through the inside of the main body 30 is discharged. The air sucked from the head unit 10 is sucked into the cleaner main body 30 through the suction pipe 55 and passes through the inner air flow path 35 to the outside of the main body 30 through the discharge port 81. The outlet 81 may be disposed on at least one of the left and right sides of the main body 30. The discharge port 81 may be provided in a plurality of holes. The discharge port 81 may be provided on the discharge plate 80. The discharge plate 80 may be detachable from the main body 30 as shown in FIG. 3. The discharge plate 80 may have a substantially circular shape. The discharge plate 80 may be formed as a curved surface and may be formed as a part of the first and second main bodies 40, 50. An exhaust filter 82 may be disposed inside the discharge plate 80.

The cleaner 1 may include a filter plate 84. The filter plate 84 may be detachable from the main body 30 to exchange a separation filter 86 therein as shown in FIG. 3. The filter plate 84 may be disposed on the other side of the discharge plate 80. That is, the discharge plate 80 may be provided on one of the left and right main bodies 46 and 47, and the filter plate 84 may be provided on the other of the left and right main bodies 46 and 47. The filter plate 84 may be formed as a curved surface and function as a part of the first and second main bodies 40 and 50.

A code doorway 91 may be provided at the rear of the main body 30 so that a code 93 for transmitting power to the cleaner 1 may be drawn out. In detail, the code doorway 91 may be provided at the rear of the first main body 40. The code 93 is stored in a code reel 90 provided in the main body 30 and provided so as to be wound inside the main body 30 by the code reel 90 until a head portion 94 provided at the end of the code 93 reaches the code doorway 91.

The cleaner 1 may include a button 49. The button 49 may include a code reel button 49*a* and a power button 49*b*. The button 49 may be provided on the upper portion of the main body 30, and the arrangement thereof is not limited. The code reel button 49*a* is configured so that the code 93 may be wound on the code reel 90 and the power button 49*b* may operate to supply power to the main body 30 via the code 93.

The cleaner main body 30 may be provided with a cleaning brush holder 95. A cleaning brush is inserted into the extension pipe 12 instead of the head unit 10 and may be stored in the cleaning brush holder 95.

FIG. 7 is a sectional view taken along line B-B' FIG. 5 and FIG. 8 is a cross-sectional view taken along line C-C' in FIG. 5.

The moving wheel 60 may be provided to rotate along the inner surface 45*a* of the main body 30. In detail, the moving wheel 60 may be formed to be spaced apart from the inner surface 45*a* of the main body 30 by a predetermined distance. The moving wheel 60 may be provided so as to be spaced apart from the inner surface 45*a* of the central main body 45 by a predetermined distance in the interior of the central main body 45. Since the moving wheel 60 is formed to be larger than the size of the main body 30, the cleaner main body 30 may be stably moved. Also, since the internal space of the moving wheel 60 may arrange the internal structures of the cleaner main body 30, space utilization of the internal space of the moving wheel 60 may be improved.

The moving wheel 60 may be supported on the inner side of the moving wheel 60 by a wheel rotation support 62. The wheel rotation support 62 may also function as a case to enclose the internal structure of the cleaner main body 30. The wheel rotation support 62 may be provided with at least one bearing 64 as shown in FIG. 8. The at least one bearing 64 may be configured to allow the moving wheel 60 to rotate smoothly relative to the wheel rotation support 62. In this embodiment, a plurality of the bearings 64 are disposed circumferentially spaced along the wheel rotation support 62, but the arrangement position thereof and the number of the bearings 64 are not limited.

The suction motor 97 is provided to generate a suction force in the main body 30. The suction motor 97 may be provided on the inner air flow path 35 inside the main body 30.

The suction motor 97 may be provided at a lower portion of the main body 30. The center of gravity G of the cleaner main body 30 may be positioned lower than the center of the main body 30 because the suction motor 97 is provided below the main body 30. A suction motor case 98 provided around the suction motor 97 may be provided around the suction motor 97. The suction motor case 98 may form part of the inner air flow path.

A control device 99 may be disposed in front of the suction motor 97. The control device 99 is also disposed on the lower side of the main body 30 together with the suction motor 97 so that the center of gravity G of the cleaner main body 30 is positioned below the center of the main body 30.

The cleaner 1 may include the code reel 90.

The code reel 90 is configured such that the code 93 for transmitting power to the cleaner is wound. The code reel 90 is rotatably provided and the code 93 may be wound around the outer circumference of the code reel 90 by the rotation of the code reel 90.

FIG. 9 is a sectional view taken along line A-A' in FIG. 4.

An inner air flow path starting from the suction pipe 55 may be provided inside the main body 30. The inner air flow path may be connected to the discharge port 81 through the separation filter 86, the suction motor 97, and the exhaust filter 82.

The separation filter 86 may be disposed inside the filter plate 84 and the exhaust filter 82 may be disposed inside the exhaust plate. The separation filter 86 and the exhaust filter 82 are arranged to filter foreign matter in the air moving through the inner air flow path 35.

The separation filter 86 and the exhaust filter 82 may be exposed to the outside by separating the filter plate 84 and the exhaust plate from the main body 30 and the filter may be exchanged through this process.

Hereinafter, the operation of the cleaner main body 30 to return to the home position by itself will be described.

FIGS. 10 to 13 are views illustrating rolling operations of the cleaner main body according to an embodiment of the present disclosure.

FIG. 10 shows a case where the cleaner main body 30 is rotated sideways, and FIG. 11 is a view of the cleaner main body 30 inclined in FIG. 10 as viewed from the front of the main body 30. In FIG. 11, T1*a* represents an arbitrary contact point at an angle obtained when the cleaner main body 30 is viewed from the front of the main body 30 in a plurality of contacts or tangent lines T1. The main body 30 forms a tangent line or at least two contact points with the bottom surface F of the side surfaces of the first and second main bodies 40 and 50 and contacts the bottom surface F. The center of gravity (G) of the main body 30 is located at a lower portion of the main body 30 than an intersection (A) formed by an imaginary plane P1 formed by the tangent line or the normal line from at least two contact points and a center line C of the main body 30. As a result, a moment M1 generated in the center of gravity (G) is generated in the main body 30 and the main body 30 rotates along the curved surface formed on the first and second main bodies 40, 50 in the direction of the arrow so that the moving wheel 60 contacts the bottom surface F and returns to the original position.

FIG. 12 shows a case where the cleaner main body 30 further rotates sideways as compared with the case of FIG. 10 and FIG. 13 is a view of the cleaner main body 30 inclined in FIG. 12 viewed from the front of the main body 30. In FIG. 13, T2*a* denotes an arbitrary contact point at an angle when the cleaner main body 30 is viewed from the front of the main body 30 in a plurality of contacts or tangent lines T2. The main body 30 forms a tangent line or at least two contact points with the bottom surface F of the side surfaces of the first and second main bodies 40 and 50 and contacts the bottom surface F. The center of gravity (G) of the main body 30 is located at a lower portion of the main body 30 than an intersection (B) formed by an imaginary plane P2 formed by the tangent line or the normal line from at least two contact points and the center line C of the main body 30. As a result, a moment M2 generated in the center of gravity G is generated in the main body 30 and the main body 30 rotates along the curved surface formed on the first and second main bodies 40 and 50 in the direction of the arrow so that the moving wheel 60 contacts the bottom surface F and returns to the original position.

The case where the main body 30 is turned upside down is not shown. However, the upper part of the main body 30 is formed as a curved surface, the main body 30 is rotated in either the right or left direction and the main body 30 is returned to the original position while changing to the same position as the cleaner main body 30 in FIG. 10 or FIG. 12.

Hereinafter, a cleaner according to another embodiment of the present disclosure will be described.

Description of the constitution overlapping with the above description is omitted.

FIG. 14 is a side view of a cleaner main body according to another embodiment of the present disclosure. FIG. 15 is a rear view of a cleaner main body according to another embodiment of the present disclosure. FIG. 16 is a bottom view of a cleaner main body according to another embodiment of the present disclosure.

A moving wheel 160 may be provided behind the main body 30. In detail, the moving wheel 160 may be provided behind a first main body 140. The center of rotation R2 of the moving wheel 160 may be located at the rear lower portion of the first main body 140 and both sides of the main body may be arranged on both sides of the moving wheel 160. The first main body 140 includes a central main body 145 having an opening 145*a* at least partially open so that the moving wheel 160 passes and the moving wheel 160 may contact the floor surface F, a left main body 146 disposed on the left side of the moving wheel 160 and a right main body 147 disposed on the right side of the moving wheel 160 when the main body is viewed from the front with respect to the advancing direction of the main body 30. The moving wheel 160 is disposed in the central main body 145 and the left and right main bodies 146 and 147 are disposed on the left and right sides of the moving wheel 160 so as to cover the left and right sides of the moving wheel 160 to minimize wear and tear by external influences.

The moving wheel 160 may be eccentrically rotated on the rear side of the main body 30. The moving wheel 160 may be disposed at a rear lower portion of the first main body 140 and the center of rotation R2 may be disposed at a rear lower portion of the first main body 140. Accordingly, the space occupied by the moving wheel 160 in the main body 30 may be minimized, and the center of gravity G2 of the main body 30 may be positioned below the center of the main body 30 by providing the suction motor 97 in front of the moving wheel 160. Further, as the moving wheel 160 is positioned at the rear lower portion of the first main body 140, the utilization space inside the main body 30 may be relatively widened. The center of gravity of the cleaner main body 30 may be positioned below the center of the main body by arranging the suction motor 97, a control device, and a dust separator in front of the moving wheel 160 in the main body 30.

Hereinafter, a cleaner according to another embodiment of the present disclosure will be described.

Description of the constitution overlapping with the above description is omitted.

FIG. 17 is a perspective view of a cleaner according to another embodiment of the present disclosure. In this embodiment, a dust separator 122 may be configured in the cleaner main body 30.

The dust separator 122 is provided to remove foreign matter from the air flowing from the head unit 10. In the present embodiment, the dust separator 122 is provided in the cleaner main body 30 to filter out foreign matter in the air sucked into the suction pipe 55 ahead of the cleaner main body 30. For this purpose, the air passing through the head unit 10 and the extension pipe 12 is made to flow to the hose 20 through the dust separator 122.

The dust separator 122 is provided in front of the cleaner main body 30 as shown in the figure, but not limited thereto, and may be provided inside the cleaner main body 30.

Although a few embodiments have been shown and described, it will be appreciated by those having ordinary skill in the art that changes may be made in these embodiments without departing from the principles and spirit of the disclosure, the scope of which is defined in the claims and their equivalents.

The invention claimed is:

1. A cleaner comprising:

a cleaner main body including:

a first main body formed in a spherical shape; and a second main body formed having side surfaces that extend in parallel with side surfaces of the first main body that are opposite to each other, the second main body being formed to protrude from the side surfaces of the first main body toward a front of the first main body such that a width at a second point of the second main body located forward of a first point of the second body is smaller than a width at the first point.

2. The cleaner of claim 1, wherein both of the side surfaces of the second main body extend from both of the side surfaces of the first main body.

3. The cleaner of claim 1, wherein of the both side surfaces of the second main body are formed in a plane having a curvature at least partially in a vertical direction.

4. The cleaner of claim 1, wherein the second main body protrudes forward and downward from the first main body.

5. The cleaner of claim 1, wherein the second main body is protruded such that a height of the second main body at the second point is smaller than a height of the second main body at the first point.

6. The cleaner of claim 1, wherein the second main body is formed with curved surfaces at both lower sides thereof.

7. The cleaner of claim 1, wherein the second main body is arranged that a curvature at a lower portion of both of the side surfaces of the second main body at the second point, which is provided in front of the first point, is larger than a curvature at both sides of the second main body at the first point.

8. The cleaner of claim 1, wherein the cleaner further includes a moving wheel that rotates along an inner circumferential surface of the first main body and is rotatably provided for movement of the cleaner main body.

9. A cleaner comprising:

a cleaner main body:

a first main body formed in a spherical shape; and a second main body protruding from the front of the first main body such that the width at a second point located forward of a first point is smaller than the width at the first point, a moving wheel that rotates along an inner circumferential surface of the first main body and is rotatably provided for movement of the cleaner main body, wherein the moving wheel is arranged at a center of the cleaner main body.

10. The cleaner of claim 8, wherein the first main body includes:

a central main body in which the moving wheel is disposed; and a left and right main body provided on left and right sides of the central main body.

11. The cleaner of claim 10, wherein the central main body is open such that at least a part of the moving wheel is exposed on a floor surface.

12. The cleaner of claim 8, wherein the cleaner further includes a pair of auxiliary wheels disposed on both sides of the moving wheel and protruding rearward from the cleaner main body.

13. The cleaner of claim 8, wherein the cleaner further includes a direction switching unit provided below the second main body and rotatable in the left and right direction for changing the direction of the cleaner main body.

14. The cleaner of claim 1, wherein the cleaner main body further includes a discharge plate having at least one of both sides of the first main body provided with a discharge port through which air sucked into the cleaner main body is discharged, and the cleaner further includes an exhaust filter provided inside a suction port to filter the air flowing through the cleaner.

15. The cleaner of claim 14, wherein the discharge plate is detachably provided from the cleaner main body, and the exhaust filter is detachably provided through a space in which the discharge plate is separated.

* * * * *